US005244113A

United States Patent [19]

Stymiest

[11] Patent Number: 5,244,113

[45] Date of Patent: Sep. 14, 1993

[54] CONTAINER LID ASSEMBLY

[75] Inventor: Charles A. Stymiest, St. Louis, Mo.

[73] Assignee: Northwestern Bottle Company, St. Louis, Mo.

[21] Appl. No.: 933,654

[22] Filed: Aug. 24, 1992

[51] Int. Cl.[5] ..... B65D 47/08; B65D 51/18

[52] U.S. Cl. ..... 220/710.5; 220/307; 220/254; 220/337; 220/703; 220/705; 220/709; 220/711; 220/717; 220/212.5; 215/1 A; 215/228; 215/229; 215/100 A; 229/103.1; 222/482; 222/498; 222/545; 222/546

[58] Field of Search ..... 220/307, 254, 256, 337, 220/339, 703, 705, 709, 710.5, 711, 713, 717, 752, 760, 761, 768, 775, 212.5, 524, 526; 215/1 A, 228, 229, 238, 355; 229/103.1; 222/481.5, 482, 545, 546, 556, 498

[56] References Cited

U.S. PATENT DOCUMENTS

| | | | |
|---|---|---|---|
| 1,362,713 | 12/1920 | McColl | 220/212.5 |
| 2,372,281 | 3/1945 | Jordan | 222/482 X |
| 2,747,776 | 5/1956 | Hentschke et al. | 222/482 X |
| 2,754,866 | 7/1956 | Coltman, Jr. | 220/254 X |
| 2,790,475 | 4/1957 | Close | 220/254 |
| 2,792,958 | 5/1957 | Beyer | 215/100 A |
| 2,826,338 | 3/1958 | Davis | 220/524 X |
| 3,043,471 | 7/1962 | Coulson et al. | 220/212.5 |
| 3,119,541 | 1/1964 | Lynn | 220/212.5 X |
| 3,159,320 | 12/1964 | Scholtz | 222/482 X |
| 3,281,002 | 10/1966 | Geiss | 215/355 |
| 3,341,047 | 9/1967 | Nauta | 215/100 A |
| 3,372,832 | 3/1968 | Yeater et al. | 220/254 |
| 4,004,710 | 1/1977 | Crisci | 220/306 |
| 4,083,467 | 4/1978 | Mullins et al. | 220/90.4 |
| 4,180,179 | 12/1979 | Hoenig et al. | 220/307 |
| 4,213,537 | 7/1980 | Caccavale | 220/215 |
| 4,213,538 | 7/1980 | Boardman | 220/268 |
| 4,279,358 | 7/1981 | Jacobs | 220/321 |
| 4,441,640 | 4/1984 | Lottick | 220/705 X |
| 4,442,952 | 4/1984 | Patarini | 220/354 |
| 4,474,303 | 10/1984 | Maccise | 220/212.5 X |
| 4,754,898 | 7/1988 | Britt et al. | 222/487 X |
| 4,865,233 | 9/1989 | Kain | 222/482 X |
| 4,955,503 | 9/1990 | Propes | 220/526 |
| 4,978,024 | 12/1990 | Newman et al. | 220/90 |
| 4,993,606 | 2/1991 | Bolen, Jr. et al. | 222/546 |
| 5,086,614 | 2/1992 | Dumestre | 220/713 |
| 5,097,977 | 3/1992 | Straub | 220/307 |
| 5,110,002 | 5/1992 | Tucker | 220/254 |
| 5,154,917 | 10/1992 | Ibrahim et al. | 215/228 X |

*Primary Examiner*—Allan N. Shoap
*Assistant Examiner*—Vanessa Caretto
*Attorney, Agent, or Firm*—Polster, Lieder, Woodruff & Lucchesi

[57] ABSTRACT

A lid assembly for a container is provided having a pour opening and a drinking straw opening, each opening having a corresponding closure hingedly connected to the lid. Each closure employs a novel sealing plug that matingly engages the opening to seal the opening with both a friction seal and a snap-fit seal. The lid assembly also has an independently formed handle hingedly connected to the lid for carrying.

8 Claims, 3 Drawing Sheets

CONTAINER LID ASSEMBLY

BACKGROUND OF THE INVENTION

This invention relates to a container lid, more particularly, to a container lid assembly for the use on the open end of a liquid or beverage container, the lid having an opening for pouring and an opening through which a drinking straw can be inserted. The lid assembly also employs hinged closures for sealing off each of the openings with a novel leak resistant friction and snap-fit sealing means. The lid assembly also contains a hinged handle attached thereto for carrying the lid/container assembly.

Consumers often use light-weight, portable bottles or containers to transport beverages, for example, soft drinks, lemonade, iced tea, or ice water. The most popular containers employ an opening through which the liquid in the container can be poured into a drinking glass or directly consumed by the user. The opening can be closed with a closure, plug or lid to prevent leaking.

Often these containers employ lids that have an opening through which a drinking straw is inserted. Also, other containers, such as sports drinking bottles, have a pull-open drinking spout such as the sports bottle closure illustrated in my co-pending design patent application Ser. No. 07/784,799, filed Oct. 30, 1991.

Many times these light-weight plastic container and lid assemblies are used as promotional items by beverage manufacturers or as incentives or novelty giveaways by fast food restaurant. The containers are filled with a beverage, for example, soda pop, and sold to the consumer or given away as an advertising promotion, providing the consumer with a souvenier that can be reused at home.

An ideal container would employ a lid assembly that has an opening for pouring, an opening for insertion of a drinking straw, and closure means for sealing each of the openings to prevent leakage. Furthermore, an ideal lid would have a handle fashioned thereon so that the container and its contents can be easily transported. The user often fills the container with a combination of beverage and ice. It would be advantageous, therefore, to have a lid with a pour opening that would allow the outflow of the beverage, but would block the outflow of the ice.

Container closures, many of which are not particularly suitable for use on a beverage container, are well-known to the art. U.S. Pat. No. 4,004,710 to Crisci discloses a combination container and closure, both of which are formed of a plastic material and employ a snap engagement seal. U.S. Pat. No. 4,442,952 to Patarini discloses a two-piece closure for use with a container employing a ring and plug assembly forming a friction engagement. U.S. Pat. No. 4,279,358 to Jacobs also discloses a container lid employing a snap-fit sealing engagement.

End closures for use on a drinking container are also known to the art. For example, U.S. Pat. No. 4,213,538 to Caccavale, discloses an insulated cover assembly for a paper cup. The cover assembly comprises a lid made of plastic material having vents or openings. U.S. Pat. No. 4,083,467 to Mullins et al. discloses an infant training tumbler having a cap affixed to one end and having at least one opening in the cap permitting the outflow of liquid. U.S. Pat. No. 4,978,024 to Newman et al. discloses a container lid for a drinking cup having an upstanding collar formed around the periphery and at least one orifice for a beverage to be drunk therethrough; the cap being designed as an anti-splash lid for a drinking cup.

SUMMARY OF THE INVENTION

It is, therefore, an object of the present invention to provide a lid assembly for a beverage container having an opening through which liquid can be poured and another opening into which a drinking straw can be inserted.

Another object of the invention is to provide a lid assembly having closures hingedly connected thereto, one closure constructed to seal the pour opening and the other closure constructed to seal the straw opening.

Yet another object of the invention is to provide a lid assembly employing a novel sealing means where the pour opening and the straw opening are each sealed by a plug portion of their respective hinged closures, each plug functioning to seal each opening with both a friction seal and a snap-fit seal.

Another object of the invention is to provide a cap assembly having a pour opening with means to prevent the outflow of ice or other solid material from inside of the container.

Still another object of the invention is to provide a lid assembly having a carrying handle, hingedly attached, for carrying the container assembly.

Briefly stated, a container lid assembly is provided with a pour opening and a drinking straw opening, each opening having a corresponding closure apparatus hingedly connected to the lid. Each closure apparatus employs a plug constructed to fit within the respective pour and straw openings, with each plug cooperating with its respective opening to provide both a friction seal and a snap-fit seal within the respective opening. The pour opening has a grate or other means constructed therein to prevent the outflow of ice or other solid materials from the container. The lid assembly also has a carrying handle hingedly connected thereto.

DESCRIPTION OF THE PREFERRED EMBODIMENT

Figure 1:
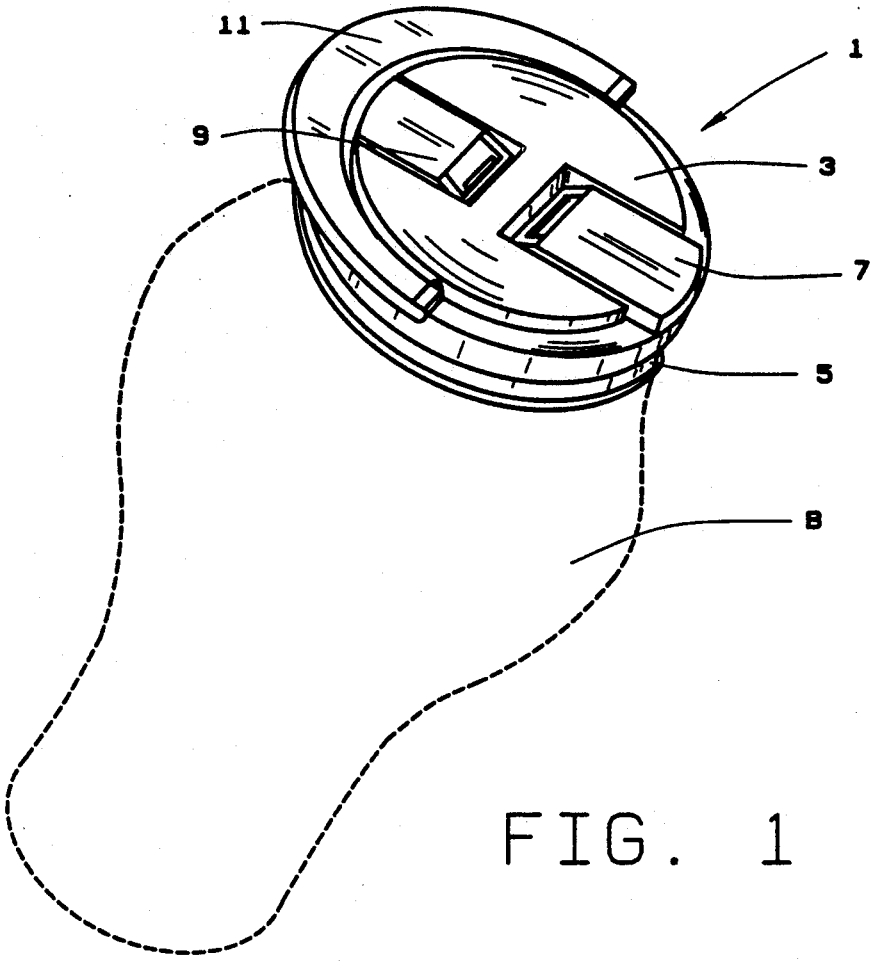
FIG. 1 is a perspective view of the lid assembly of the present invention with an associated container being shown in phantom lines to illustrate environment.

The lid assembly of the present invention is shown generally at 1 in FIG. 1. Lid 1 is constructed of an appropriate material, for example, injection molded plastic and has a top wall 3 with a depending circumferential side wall 5 constructed to mount on bottle B. Wall 5 can have internal threads (not shown) or other means for mounting on a container or bottle.

Figure 2:
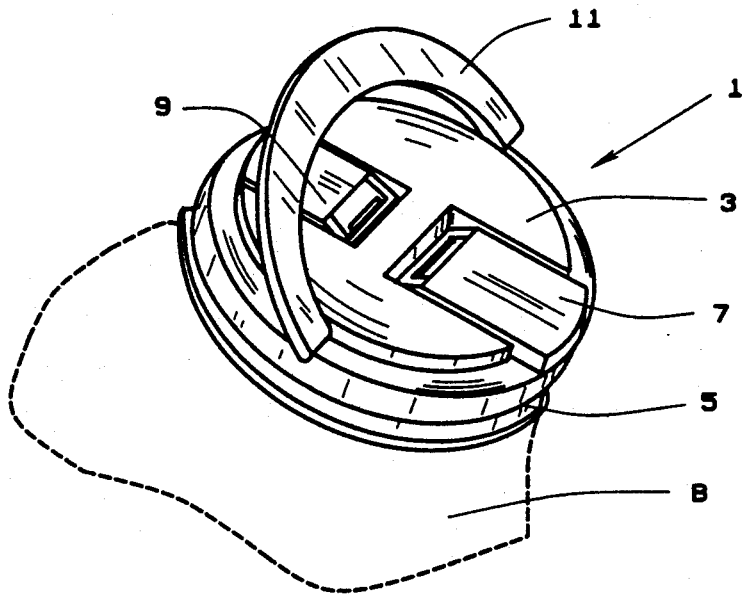
FIG. 2 is another perspective view of the lid assembly of the present invention an associated container partially shown in phantom lines and showing a lid handle in position for grasping by a user.

Lid 1 has a first closure 7 hingedly connected to top wall 3 and a second closure 9 also hingedly connected to top wall 3, each closure being constructed to seal a pour opening and a drinking straw access opening, respectively, as will be described in greater detail hereinafter. Carrying handle 11 is also hingedly attached to top wall 3 and can be pivoted from a position flush with top wall 3, as shown in FIG. 1, or pivoted up from wall 3 to a usable position for carrying, as shown in FIG. 2. Each of the novel features and components of lid assembly 1 will now be described in greater detail.

Figure 3:
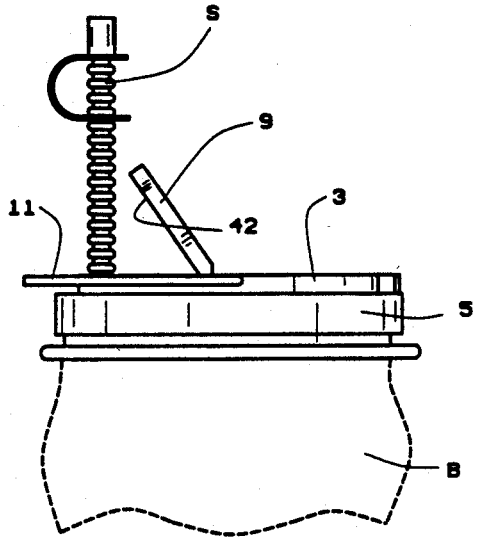
FIG. 3 is a side elevational view of the lid assembly of the present invention with an associated container partially shown in phantom lines and illustrating a drinking straw inserted through the straw opening.
Figure 4:
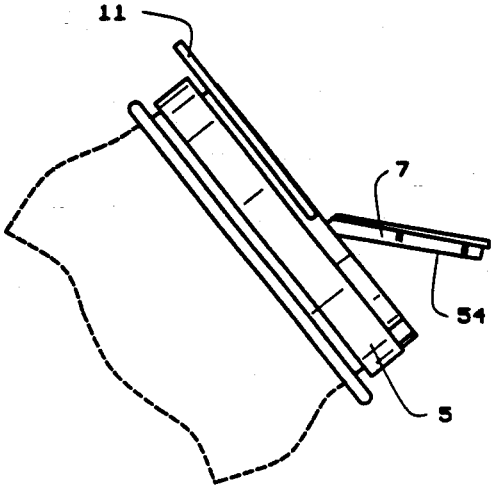
FIG. 4 is a side elevation of the lid assembly of the present invention with an associated container partially shown in phantom lines and illustrating the pour opening.
Figure 5:
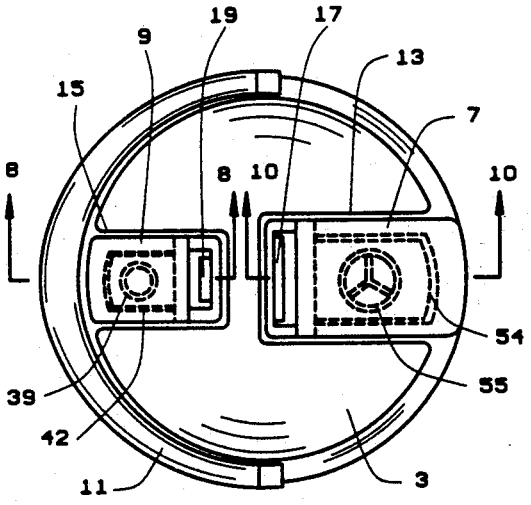
FIG. 5 is a top plan of the lid assembly of the present invention with a pair of hinged closures in closed position.

Lid assembly 1 is constructed to allow insertion of a drinking straw S as shown in FIG. 3, or to permit pouring as illustrated in FIG. 4. FIG. 5 illustrates the component of lid assembly 1, when closures 7 and 9 are in a sealed position. Top wall 3 has recesses 13 and 15 with restricted throats formed therein to seat and hold first closure 7 and second closure 9, respectively while moved in their open and closed positions. Ramp elements 17 and 19 extend at an angle to the top wall 3 so as to engage and hold hinge elements 21 and 23 of the closures 7 and 9, respectively while allowing the hinge elements 21, 23 to rotate therein, in order to provide the desired pivotal movement of the closure from open to closed.

Figure 6:
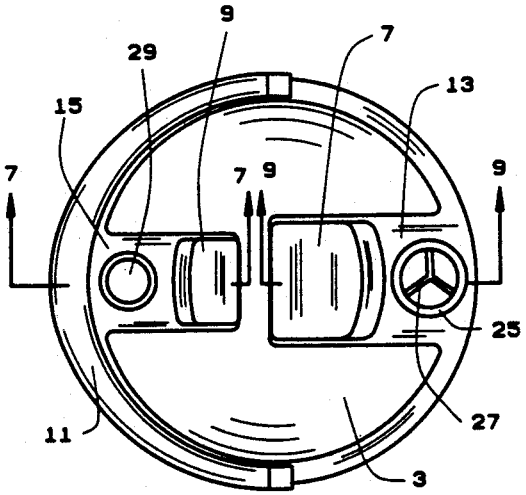
FIG. 6 is a top plan of the lid assembly of the present invention with a pair of hinged closures in opened position.

FIG. 6 illustrates the arrangement of lid assembly 1 when the closures are pivoted to an open position. When closure 7 is pivoted up, pour opening 25 is exposed exposing grate 27 which is formed in the pour opening 25. Grate 27 allows liquid to be poured from the container through opening 25, yet traps and blocks the outflow of ice cubes or any other solids, such as fruit slices. As illustrated in the drawings, grate 27 is shown in a tricuspid shape; however, any shape can be employed that will allow liquid to be poured while also trapping any solids in the container.

Figure 7:
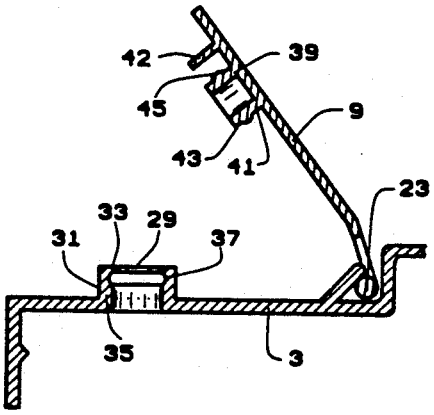
FIG. 7 is a partial cross-sectional view of the drinking straw opening and its corresponding hinged closure in an open position, taken along lines 7—7 of FIG. 6.
Figure 8:
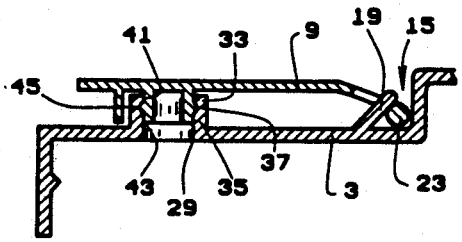
FIG. 8 is a partial cross-sectional view of the drinking straw opening with its corresponding hinged closure in a closed position, taken along lines 8—8 of FIG. 5.
Figure 9:
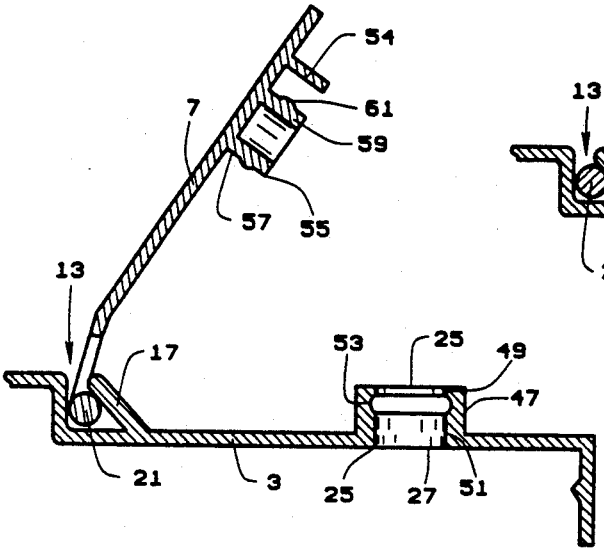
FIG. 9 is a partial cross-sectional view of the pour opening and the corresponding closure in an open position taken along line 9—9 of FIG. 6.

The novel construction and relationship of the pour opening 25 and straw opening 29 to their corresponding hinged closures is best illustrated in FIGS. 7-10. FIGS. 7 and 8 illustrate the construction of straw opening 29 and its corresponding closure 9. Closure 9 is pivotally attached to top wall 3 as previously described. When closure 9 is pivoted to an open position (FIG. 7), opening 29 is exposed to allow the insertion of a drinking straw or to allow venting of the container during pouring. Opening 29 is formed in top wall 3 in an upwardly extending hollow wall or ring 31. Ring 31 has an upper outer end 33 and a lower inner end 35, with a sealing groove 37 formed between the ends. Correspondingly, closure 9, has a spaced surrounding hollow wall 42 and plug 39 both of which depend from closure 9. When mounted within recess 15, the hollow plug 39 of closure 9 is situated within opening 29 on the ring 31 (see FIG. 8) Hollow plug 39 has an inner end 41 and outer end 43 with a circumferential sealing ring 45 formed therebetween. Plug 39 has external dimensions relative to the internal dimensions of opening 29 that allow it to complimentary and matingly engage opening 29 of ring 31. When closure 9 is pivoted down to mate with opening 29, the novel plug and opening construction serves to completely seal off opening 29 to prevent leakage as shown in FIG. 8. In this regard, note that inner end 41 and outer end 43 of plug 39 engage upper end 33 and lower end 35 of ring 31 in a tight friction seal At the same time, sealing ring 45 seats in groove 37 in a tight, snap-fit seal.

Figure 10:
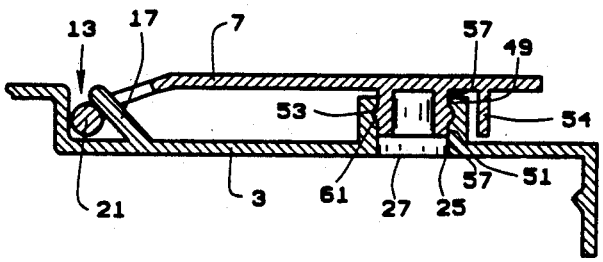
FIG. 10 is a partial cross-sectional view of the pour opening with its closure structure in a closed position, taken along lines 10—10 of FIG. 6.

The structural and functional relationship between closure 7 and pour opening 25 is analogous to the structural and functional relationship of straw opening 29 and closure 9. Closure 7 is pivotally attached to top wall 3 as previously described. When closure 7 is pivoted to an open position (see FIG. 9) opening 25 is exposed to allow pouring. Opening 25 is formed in top wall 3 in an upwardly extending hollow wall opening 47. The ring 47 has an upper end 49 and lower end 51 with sealing groove 53 formed between the ends. Correspondingly, closure 7 has spaced wall 54 surrounding hollow plug 55 (see FIG. 5), both depend from closure 9. When hingedly mounted within recess 13, the hollow plug 55 of closure 9 is received within opening 25 (see FIG. 10). Plug 55 has an inner end 57 and outer end 59 with a circumferential sealing ring 61 formed between the ends. Plug 55 has external dimensions relative to the internal dimension of opening 25 that allow it to be complimentary and matingly engaged within opening 25 of ring 47. When closure 7 is pivoted down to engage opening 25, the novel plug and opening design serves to completely seal off opening 25 to prevent any leakage. As shown in FIG. 10, inner end 57 and outer end 59 of plug 55 engage upper end 49 and lower end 51 of ring 47 respectively in a tight friction seal. Furthermore, sealing ring 61 seats in groove 53 in a tight snap-fit seal.

Figure 11:
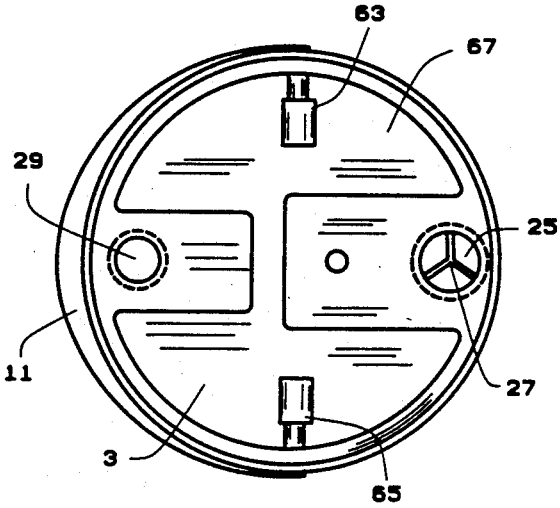
FIG. 11 is a bottom plan of the lid assembly of the present invention.

The entire lid and container assembly can be carried by handle 11 as illustrated in FIG. 2. Handle 11 is hingedly connected to top wall 3 through seal hinge bosses 63 and 65 integrally formed in the bottom surface 67 of the top wall (FIG. 11). Therefore, the only openings cooperating between the inside of the container and the outside environment are pour opening 25 and straw opening 27, when opened.

As thus described, a versatile and novel lid assembly is provided having a pour opening and a straw opening, both easily sealable against leakage by corresponding hingedly connected closure elements which employ a novel combined friction seal and snap-fit seal.

As various changes can be made in the above construction without departing from the scope of the invention, it is intended that all matter contained in the above description or as shown in the accompanying drawings be interpreted as illustrative and not in a limiting sense.

What is claimed is:

1. An integral molded plastic lid comprising:

a top wall having a circumferential side wall depending therefrom for mounting over an open upper end of a container, said top wall having a first and second recess formed therein;

said top wall having a first upwardly extending hollow wall section within said first recess having an open lower end of a sufficient size to allow pouring therethrough when said lid is mounted on said container;

said first upwardly extending hollow wall section having an internal circumferential sealing groove between an upper and lower end thereof;

a first closure hingedly mounted within said first recess and having a first plug depending therefrom corresponding in shape to said first upwardly extending hollow wall section, said first plug having an inner and outer end thereof for engaging said upper and lower end of said first upwardly extending hollow wall section in frictional engagement;

said first plug having an external circumferential sealing ring between said inner and outer end thereof for engaging said sealing groove in snap fitting engagement;

said top wall also having a second upwardly extending hollow wall section within said second recess having an open lower end of sufficient size for the insertion of a drinking straw therethrough when said lid is mounted on said container;

said second upwardly extending hollow wall section also having a circumferential sealing groove between an upper and lower end thereof;

a second closure hingedly mounted within said second recess and having a second plug depending therefrom corresponding in shape to said second upwardly extending hollow wall section, said second plug having an inner and outer end thereof for engaging said upper and lower end of said second upwardly extending hollow wall section in a frictional fit engagement;

said second plug having an external circumferential sealing ring between said inner and outer end thereof for engaging said sealing groove in said second upwardly extending hollow section in snap-fitting engagement.

2. The integral molded plastic lid of claim 1 and further comprising means on said lower end of said first upwardly extending hollow wall section for blocking the outflow of ice cubes during pouring.

3. The integral molded plastic lid of claim 2 wherein said means for blocking the outflow of ice cubes during pouring further comprises a grate element.

4. The integral molded plastic lid of claim 1 and further comprising an independent handle hingedly connected to said top wall.

5. The integral molded plastic lid of claim 1 wherein said means for blocking the outflow of ice cubes during pouring further comprises a tricuspid shaped grate element.

6. An integral molded plastic lid comprising:

a top wall having a circumferential side wall depending therefrom for mounting over an open upper end of a container, said top wall ahving a first and second recess formed therein;

said top wall having a first upwardly extending hollow wall section within said first recess having an open lower end of sufficient size to allow pouring therethrough when said lid is mounted on said container;

said first upwardly extending hollow wall section having an integral circumferential sealing groove between an upper and lower end thereof, the lower end of said first upwardly extending hollow wall section provided with means for blocking the outflow of ice cubes during pouring;

a first closure hingedly mounted within said first recess and having a first plug depending therefrom corresponding in shape to said first upwardly extending hollow wall section, said first plug having an inner and outer end for engaging said upper and lower end of said first upwardly extending hollow wall section in frictional fit engagement;

said first plug having an external circumferential sealing ring between an inner and outer end thereof for engaging said sealing groove in snap-fitting engagement;

said top wall also having a second upwardly extending hollow wall section within said second recess, having an open lower end of sufficient size for the insertion of a drinking straw therethrough when said lid is mounted on said container;

said second upwardly extending hollow wall section also having a circumferential sealing groove between an upper and lower end thereof;

a second closure hingedly mounted within said second recess and having a second plug depending therefrom corresponding in shape to said second upwardly extending hollow wall section, said second plug having an inner and outer end thereof for engaging said upper and lower end of said second upwardly extending hollow wall section in frictional fit engagement;

said second plug having an external circumferential sealing ring between an inner and outer end thereof for engaging said sealing groove in said second upwardly extending hollow wall section in a snap-fitting engagement.

7. The integral molded plastic lid of claim 6 further comprising an independent handle hingedly connected to said top wall in opposed sealed hinge bosses formed in said lid.

8. An integral molded plastic lid comprising:

a top wall having a circumferential side wall depending therefrom for mounting over an open upper end of a container, said top wall having a first and second recess formed therein;

said top wall having a first upwardly extending hollow wall section within said first recess having an opening lower end of sufficient size to allow pouring therethrough when said lid is mounted on said container;

said first upwardly extending hollow wall section having an internal circumferential sealing groove between an upper and lower end thereof, the lower end of said first upwardly extending hollow section provided with a means for blocking the outflow of ice cubes during pouring;

a first closure hingedly mounted within said first recess and having a first plug depending therefrom corresponding in shape to said first upwardly extending hollow wall section, said plug having an inner and outer end thereof for engaging said upper and lower end of said first upwardly extending hollow section in frictional fit engagement;

said plug having an external circumferential sealing ring between said inner and outer end thereof for engaging said sealing groove in snap-fitting engagement;

said top wall also having a second upwardly extending hollow wall section within said second recess having an open lower end of sufficient size for the insertion of a drinking straw therethrough when said lid is mounted on said container;

said second upwardly extending hollow wall section also having a circumferential sealing groove between an upper and lower end thereof;

a second closure hingedly mounted within said second recess and having a second plug depending therefrom corresponding in shape to said second upwardly extending hollow wall section, said second plug having an inner and outer end thereof for engaging said upper and lower end of said second upwardly extending hollow wall section in frictional fit engagement;

said second plug having an external circumferential sealing ring between said inner and outer ends thereof for engaging said sealing groove in said second upwardly extending hollow section in snap-fitting engagement; and an independent handle hingedly connected to said top wall, said handle being hingedly connected to said top wall.

* * * * *